United States Patent [19]

Ichikawa

[11] Patent Number: 4,989,539

[45] Date of Patent: Feb. 5, 1991

[54] DEVELOPING APPARATUS

[75] Inventor: Yoshiki Ichikawa, Shiki, Japan

[73] Assignee: Sharp Kabushiki Kaisha, Osaka, Japan

[21] Appl. No.: 293,415

[22] Filed: Jan. 4, 1989

[30] Foreign Application Priority Data

Jan. 6, 1988 [JP] Japan ..... 63-813[U]

[51] Int. Cl.[5] ..... G03G 15/09

[52] U.S. Cl. ..... 118/658; 118/656; 355/251

[58] Field of Search ..... 118/657, 658, 656, 653; 355/251, 253, 245, 250, 259, 261

[56] References Cited

U.S. PATENT DOCUMENTS

| | | | |
|---|---|---|---|
| 4,147,127 | 4/1979 | Terashima | 118/658 X |
| 4,449,810 | 5/1984 | Ikesue et al. | 118/658 X |
| 4,469,427 | 9/1984 | Kopp et al. | 355/251 X |
| 4,592,645 | 6/1986 | Kanai et al. | 118/689 X |
| 4,716,437 | 12/1987 | MacLellan | 118/656 X |
| 4,855,783 | 8/1989 | Takashima et al. | 355/245 X |
| 4,867,100 | 9/1989 | Yamazaki et al. | 35/253 X |

FOREIGN PATENT DOCUMENTS

| | | | |
|---|---|---|---|
| 0147765 | 9/1983 | Japan | 355/253 |
| 0252379 | 12/1985 | Japan | 355/253 |
| 0209573 | 9/1987 | Japan | 355/245 |

OTHER PUBLICATIONS

U.K. Patent Application No. 2,121,323, Dec. 1983, Yamashita et al.

*Primary Examiner*—R. L. Moses
*Assistant Examiner*—Robert Beatty

[57] ABSTRACT

A developing apparatus using a bicomponent developing material is composed of a toner and a magnetic carrier. Between a developing roller for forming a magnetic brush and a stirring member disposed adjacent the developing roller for stirring the developing material, a flat plate-shaped stirring aiding plate is positioned with spaces defined above and below the stirring aiding plate. The stirring member transports developing material toward the developing roller and stirring aiding plate. The developing material is moved by the developing roller toward the stirring member and stirring aiding plate. In this way, the developing material is allowed to flow in separate streams through the spaces between the developing roller and the stirring aiding plate, and between the stirring member and the stirring aiding plate. This permits uniform distribution of toner concentration on the developing roller along the axis thereof in order to improve the image.

32 Claims, 8 Drawing Sheets

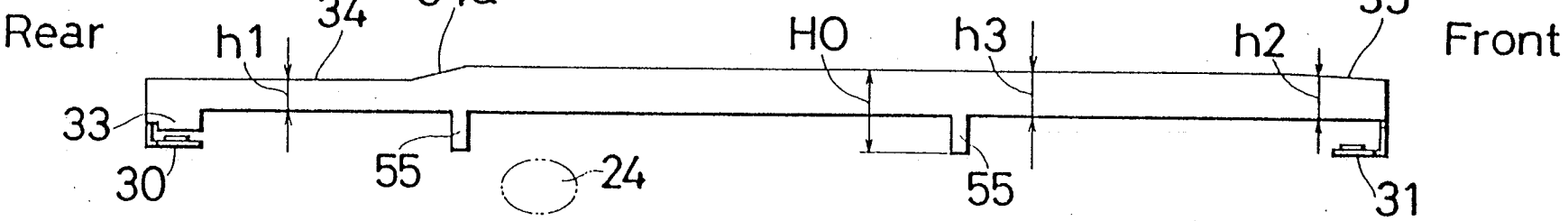
Fig. 8
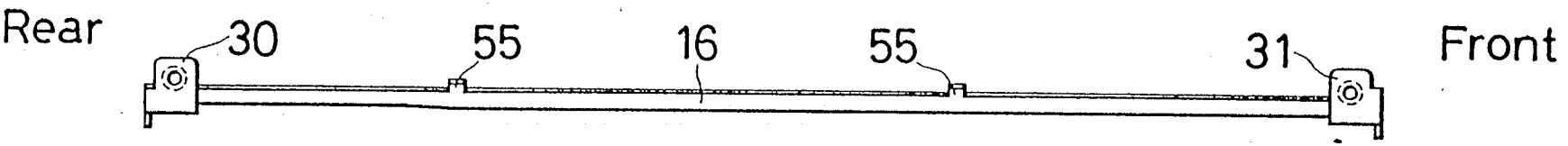
Fig. 9
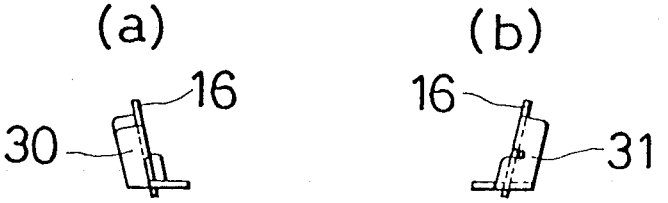
Fig. 10 (b)
Fig. 10 (a)

DEVELOPING APPARATUS

BACKGROUND OF THE INVENTION

1. Field of the Invention

The present invention relates to a developing apparatus using a bicomponent developing material consisting of a toner and a magnetic carrier and, more particularly, to a developing apparatus which is advantageously applicable to transfer-type electrostatic copying apparatus and laser printers.

2. Description of the Prior Art

A typical prior art arrangement is shown in FIG. 1. A shaft 4 is disposed between a developing roller 2 and a stirring roller 3 in a developing tank 1. The shaft 4 has a diameter of about 3 mm extends and the axial direction of the rollers 2, 3 so that the developing roller 2 can be cleaned of any remaining developing material through scraping action of the shaft 4 and so that the shaft 4 can aid in stirring. In FIG. 1, shown by numeral reference 5 is a toner concentration sensor, numeral reference 6 is an agitating roller, numeral reference 7 is a roller for supplying toner, and numeral reference 8 is a cylindrical photosensitive drum.

Recently, in the art, much attention is directed toward size reduction of the developing tank. As a result, the distance between the centers of the developing roller 2 and the stirring roller 3 tends to become smaller, so that their respective outer peripheries are brought closer to each other. In such case, the developing material is often transported irregularly due to its periodic longitudinal movement by the action of the stirring roller 3, which poses a problem that irregular shading occurs in copy images, which is largely attributable to the periodic movement of the developing material.

SUMMARY OF THE INVENTION

It is an object of the invention to provide a developing apparatus which can minimize possible unfavorable effects on image quality of such periodic movement of the developing material due to the stirring roller, and which permits smooth transport of the developing material onto the developing roller.

In order to accomplish the foregoing object, the invention provides a developing apparatus comprising:

a developing tank for storing a developing material, a developing roller disposed in the developing tank for forming a magnetic brush thereon, a stirring member for stirring the developing material in the developing tank and for transporting the developing material toward the developing roller, and a stirring aiding plate disposed between the developing roller and the stirring member, wherein the stirring aiding plate is so constructed as to leave spaces between the stirring aiding plate and the bottom of the developing tank and also between the stirring aiding plate and the top of the developing tank to allow the developing material to pass through.

According to a preferred embodiment of the invention, the developing roller and the stirring member are driven to rotate so as to move the developing material toward the stirring aiding plate upwardly from below.

According to another preferred embodiment of the invention, a sensor is disposed at a position below the developing roller and adjacent to the stirring aiding plate for detecting a magnetic intensity corresponding to the mixture ratio of a toner and a magnetic carrier.

According to another preferred embodiment of the invention, the stirring aiding plate having a plate-shaped is disposed perpendicular to a plane including the rotation axes of the developing roller and of the stirring member.

According to another preferred embodiment, the developing apparatus comprises:

a rotary shaft, first stirring blades of flat plate-shape fixed to the rotary shaft and extending with a degree of inclination relative to the axis of the rotary shaft, each first stirring blade having a notch at one end to allow the developing material to pass through in the axial direction, and second stirring blades fixed to the rotary shaft and disposed between first stirring blades, each second stirring blade extending along a diametric line of the rotary shaft.

According to a further preferred embodiment, the stirring aiding plate is configured lower at the ends in the axial direction of the stirring member than the height of its median portion.

In a developing tank 12, particles of a developing material 14, as they are moved by a developing roller 13 and a stirring member 15 through their rotation, are allowed to strike against one another in a lower space B, and further they are divided into separate streams by a stirring aiding plate 16. Thus, a turbulence effect is created in the flow of particles of the developing material 14 and a good stirring effect is provided.

Because a stirring aid plate 16 is interposed between the developing roller 13 and the stirring member 15, particles of the developing material 14 moved by the stirring member 15 are prevented from scraping those particles of the developing material 14 which form a magnetic brush on the developing roller 13.

Particles of the developing material 14 scraped by a doctor blade 25 provided for adjusting the tuft height of a magnetic brush formed on the outer periphery of the developing roller 13 may return toward the stirring member 15 by passing through an upper space A. Particles of the developing material 14 thus returned to the stirring member 15 are again stirred by the stirring member 15.

The stirring aiding plate 16 partitions the space between the developing roller 13 and the stirring member 15. Therefore, the developing material 14 forming a magnetic brush on the developing roller 13 is not liable to be scraped by the rotation of the stirring member 15 in the course of being transported on the developing roller 13.

As the stirring member 15 rotates, the developing material 14 is constantly allowed by first and second stirring blades 27;28, 28*d* of the stirring member 15 to have periodical reciprocation movement in the axial direction of the developing roller 13 and stirring member 15. By the provision of spaces A, B above and below the stirring aiding plate 16, the possibility of the flow of the developing material 14 being disturbed is eliminated and thus occurrences of irregular transport of the developing material 14 can be prevented. Thus, it is possible to ensure supply of developing material 14 in a uniform toner concentration along the axial direction of the developing roller 13, and thereby to eliminate possible irregularity in image quality.

Furthermore, particles of the developing material 14 are allowed to smoothly flow also toward a sensor 24 provided adjacent the lower space B, which enables accurate detection of toner concentration.

As is apparent from the above description, according to the invention, the developing apparatus is equipped with a stirring aiding plate interposed between the developing roller and the stirring roller, and further the stirring aiding plate has spaces defined between the stirring aiding plate and the bottom and top of the developing tank which permit flow of the developing material therein. Therefore, the stirring roller and developing roller are separated from each other by the stirring aiding plate, there being no possibility of the developing material on the developing roller being scraped off through the rotation of the stirring roller in the course of the developing material being transported. Further, it is noted that while a stagnant mass of the developing material is constantly in periodic movement in the axial direction of the stirring roller and developing roller through the action of the stirring roller, undisturbed flow of the developing material is permitted by the provision of spaces above and below the stirring aiding plate, so that possible irregularity in the transport of developing material toward the developing roller can be eliminated, and so that possible irregularity in image quality can be substantially eliminated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 8 is a front view of the stirring aiding plate 16;

FIG. 9 is a bottom view of the stirring aiding plate 16;

FIG. 10(*a*) is a side view of the stirring aiding plate 16 as seen from the rear side;

FIG. 10(b) is a side view of the stirring aiding plate 16 as seen from the front side;

DETAILED DESCRIPTION OF THE PREFERRED EMBODIMENTS

Figure 1:
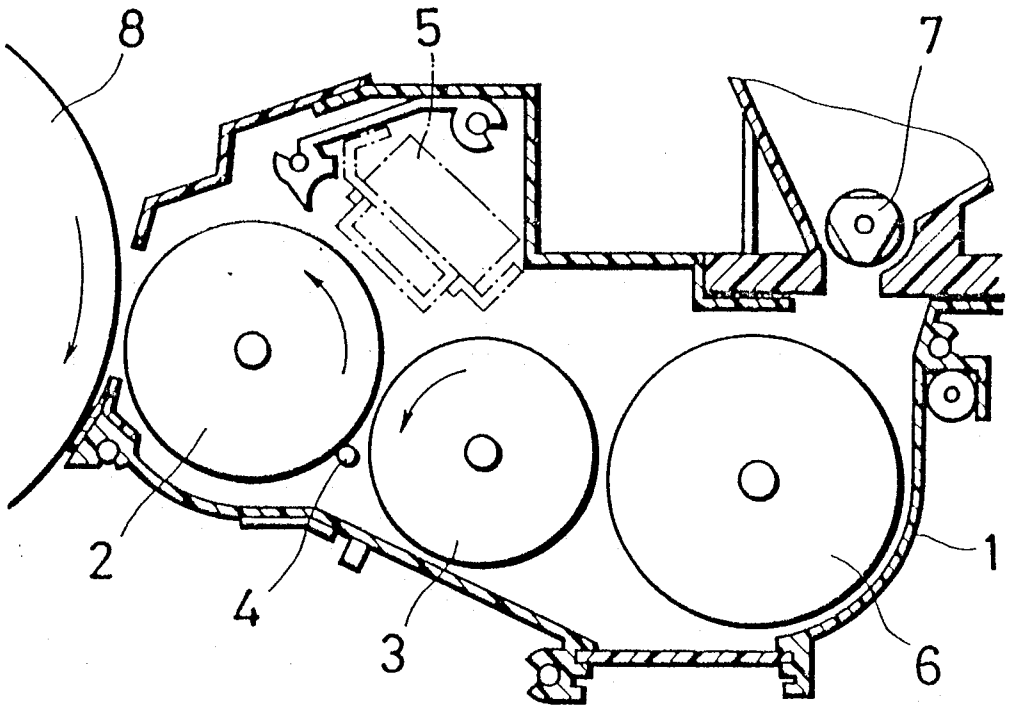
Fig. 1 PRIOR ART
FIG. 1 is a sectional view showing a typical prior art arrangement.
Figure 2:
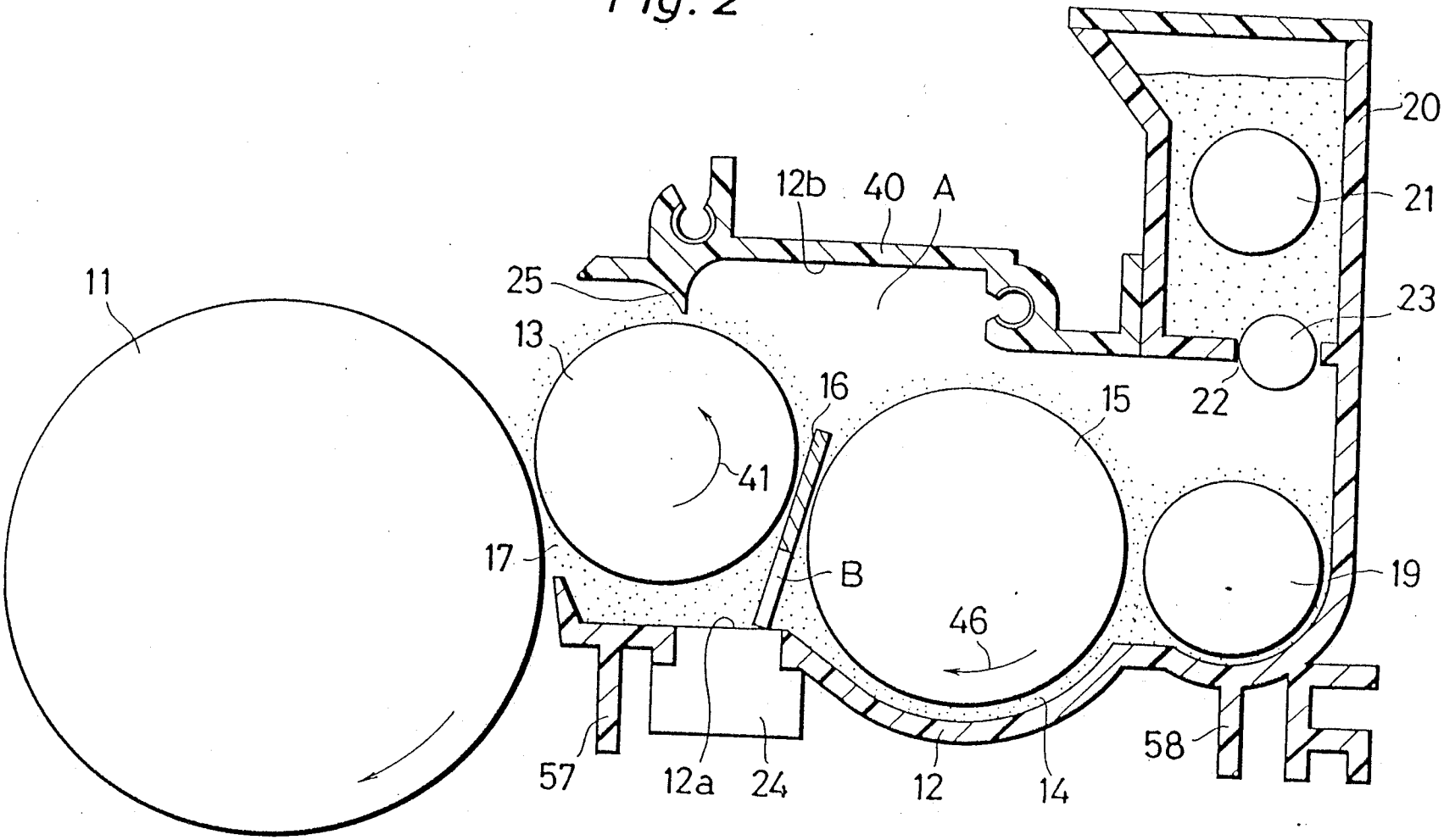
FIG. 2 is a sectional view showing a developing apparatus which represents one embodiment of the invention.

FIG. 2 is a sectional view showing a developing apparatus as one embodiment of the invention for use in a transfer-type electrostatic copying apparatus.

The developing apparatus of the invention basically includes a developing tank 12 disposed adjacent a straight cylindrical photosensitive drum 11 for storing a developing material 14, a developing roller 13 disposed in the developing tank 12 for forming a magnetic brush on its periphery, a stirring member 15 which stirs the developing material 14 in the developing tank 12, thereby to transport the developing material 14 toward the developing roller 13, a stirring aiding plate 16 interposed between the developing roller 13 and the stirring member 15, and a cover 40 for covering the developing tank 12. The stirring aiding plate 16 has spaces A, B, upper and lower, defined between it and the cover 40 and bottom 12*a* and cover 40 of the developing tank 12.

The developing tank 12 has an opening 17 which opens in opposed relation to the photosensitive drum 11. In the opening 17, the developing roller 13, is positioned while the stirring member 15 and an agitating roller 19 are disposed in a direction away from the photosensitive drum 11.

Above the agitating roller 19, a toner replenishing tank 20 is disposed for replenishing toner supply. A toner stirring roller 21 for stirring the toner is disposed in the toner replenishing tank 20, and a toner supply roller 23 is disposed at a toner replenishing port 22. A replenishing supply of toner is fed into the developing tank 12 in a quantity matching the quantity of rotation of the toner replenishing roller 23. In the developing tank 12, the toner is mixed with a magnetic carrier.

The developing roller 13 comprises a permanent magnet fixed to the developing tank 12 and a sleeve constructed of a non-magnetic material and rotatably fitted on the magnet. The sleeve is driven to rotate counterclockwise in the direction of arrow 41, as FIG. 2 shows, to transport the developing material 14 toward the stirring member 15 and the stirring aiding plate 16. The tuft height of the magnetic brush on the developing roller 13 is adjusted by a doctor blade 25.

Figure 3:
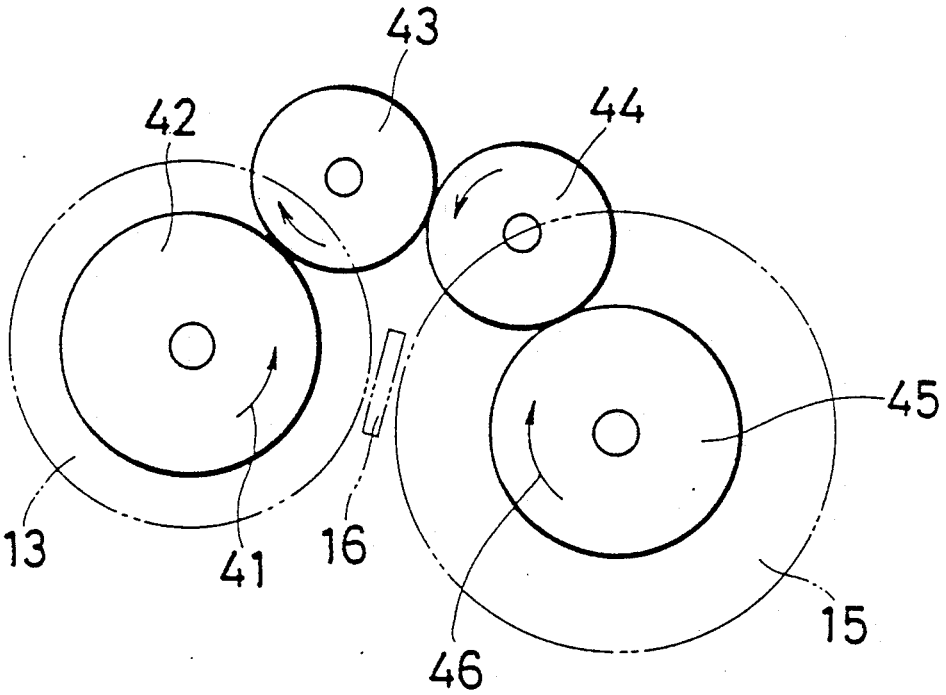
FIG. 3 is a side view showing, in simplified form, a drive arrangement for the developing apparatus.

Referring to FIG. 3, a gear 42 is fixed to the sleeve of the developing roller 13, which gear is rotated counterclockwise 41 during a predetermined period beginning from the switching on of power supply and while the photosensitive drum 11 is in rotation. The gear 42 actuates a gear 45 to rotate through idler gears 43, 44. The gear 45 is fixed to the stirring member 15, whereby the stirring member 15 is rotated clockwise in the direction of arrow 46.

Figure 4:
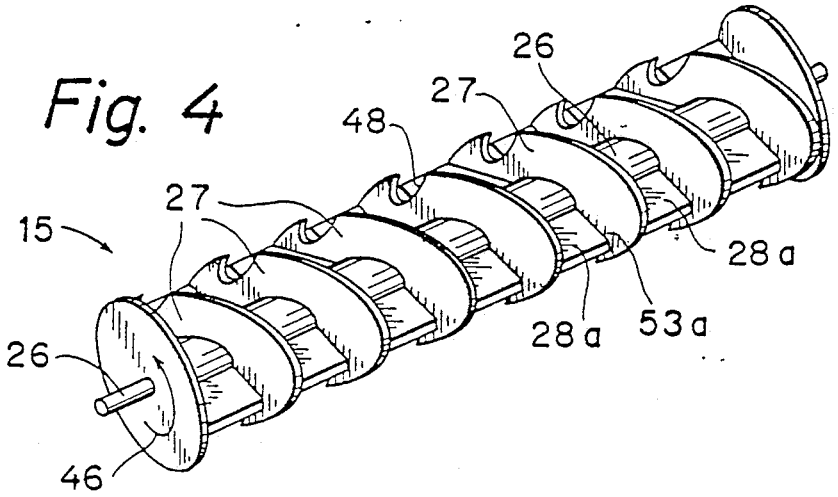
FIG. 4 is a perspective view of a stirring member 15.
Figure 5:
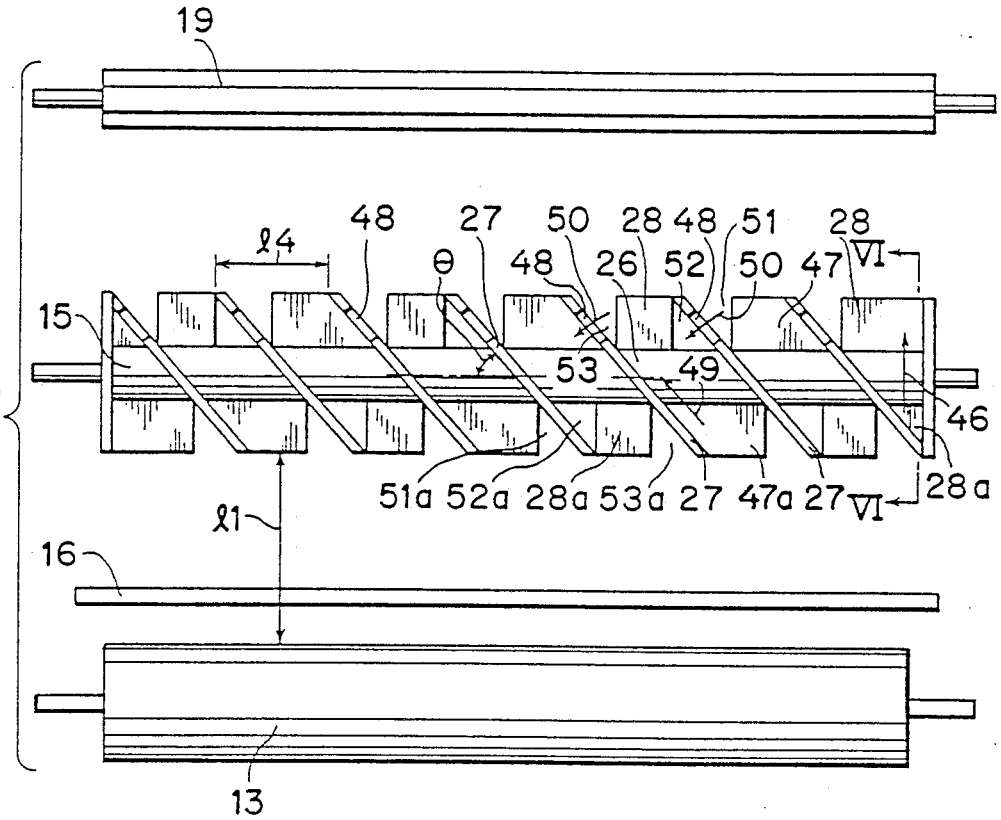
FIG. 5 is a schematic plan view of the stirring member 15 and its neighboring portion.
Figure 6:
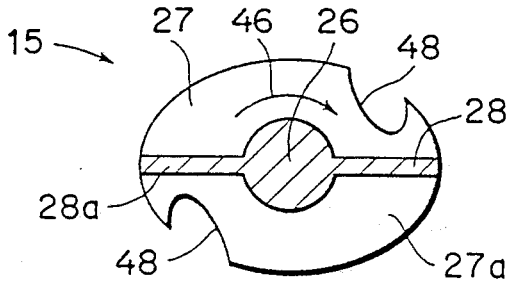
FIG. 6 is a section taken on cutting line VI-VI in FIG. 5.

FIG. 4 is a perspective view of the stirring member 15. and FIG. 5 is a plan view of the stirring member 15 and its adjacent portion. FIG. 6 is a sectional view of the stirring member 15 taken on cutting line VI—VI in FIG. 5. Referring to these figures, the stirring member 15 essentially includes a rotary shaft 26, a plurality of first stirring blades 27 mounted in inclined relation to the axial line of the rotary shaft 26, and second stirring blades 28, 28*a* fixed to the rotary shaft 26. In this embodiment, the developing roller 13 has a diameter of 24.5 mm, the stirring member 15 has a diameter of 30 mm, and the developing roller 13 and the stirring member 15 are spaced apart a distance l1 of 29.47 mm from each other. The rotational speeds of the developing roller 13 and stirring member 15 are 100.6 rpm, and 258 rpm respectively. The distance between ends of the first stirring blades 27 is indicated by 14 in FIG. 5.

The first stirring blades 27 extend with an inclination angle of $\theta$ relative to the axis of the rotary shaft 26. Each of the first stirring blades 27 has a notch 48 formed at its front end in the direction of its rotation (upper side in FIG. 5). The second stirring blades 28, 28*a* extend along a diametric line passing through the axis of the rotary shaft 26. Each first and each second stirring blade 27; 28, 28*a* are perpendicular to each other. Other second stirring blades 47, 47*a* are also configured similarly to the second stirring blades 28, 28*a*. As the rotary shaft 26 rotates in the direction of arrow 46, the developing material 14 is moved by the first stirring blades 27 in the direction of arrow 49, and is moved through the notch 48 of each first stirring blade 27 in the direction of arrow 50, whereby the developing material 14 is allowed to reciprocate in the axial directions of the rotary shaft 26. In FIG. 6, immediately below the first stirring blades 27 there is arranged another set of the first stirring blades 27*a*, by which developing material 14 is reciprocally moved in the axial directions of the rotary shaft 26. There are formed notches 51, 51*a*, 52, 52*a*, 53, 53*a* in adjoining relation to the second stirring blades 28, 28*a*, 47, 47*a* so as to allow the developing material 14 to pass through.

Figure 7:
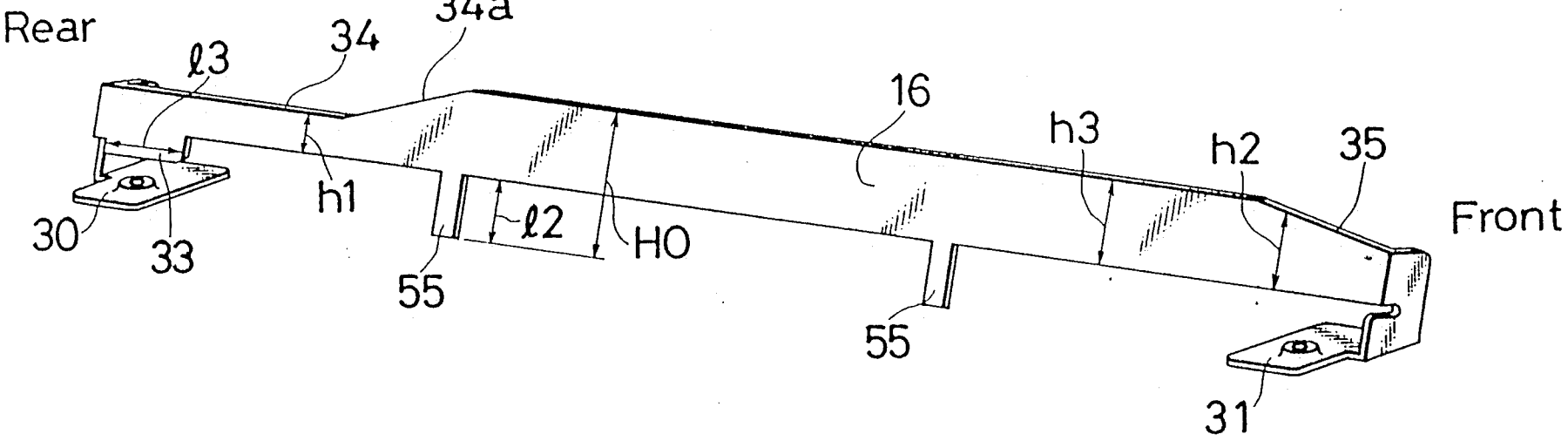
FIG. 7 is a perspective view of a stirring aiding plate 16.

FIG. 7 is a perspective view of the stirring aiding plate 16, and FIG. 8 is a front view of the stirring aiding plate 16 as viewed from the developing roller 13 side. FIG. 9 is a bottom view of the stirring aiding plate 16. FIG. 10(*a*) is a side view of the stirring aiding plate 16 as viewed from the rear side of the developing apparatus (back side of FIG. 2, and left side in FIGS. 7–9), and FIG. 10(*b*) is a side view of the stirring aiding plate 16 as viewed from the front side (front side in FIG. 2, and right side in FIGS. 7–9). The stirring aiding plate 16 is constructed of a non-magnetic metal, such as stainless steel, or a synthetic resin.

At the ends of the stirring aiding plate 16 in the axial direction of the stirring member, there are formed L-shaped support legs 30, 31 which are fixed to the bottom 12*a* of the developing tank 12. In this embodiment, the distance 12 between the stirring aiding plate 16 and the bottom 12*a* of the developing tank 12 is set at about 7 mm. It is noted, however, that at the rear side of the developing tank 12, a regulating portion 33 hangs from the stirring aiding plate 16 at a position of a distance l3 which equals 13 mm from the rear end, so that the distance between the bottom 12*a* and the stirring aiding plate 16 is quite narrow. The reason for such regulating portion 33 being provided is that at a location corresponding to the width l3 on the developing roller 13 the quantity of developing material 14 present is usually extremely small and accordingly irregular distribution of the developing material 14 is liable to occur in proportion to the pitch of the first and second stirring blades 27; 28, 28*a*. Therefore, it is intended that by provision of the regulating piece 33 the flow of developing material 14 in that area is restricted so as to prevent possible irregular stirring and irregular transport.

The height h3 of the stirring aiding plate 16 is set at about 8 mm. It is noted, however, that notches 34, 35 are formed at the front end and the rear end of the stirring aiding plate 16 so as to permit smooth flow of the developing material 14 from the stirring roller 15 to the developing roller 13, so that the height at those portions is reduced. Height hl at the rear end is lower than height h2 at the front end. This permits easy transport of the developing material 14 from the rear end to the developing roller 13, to thereby secure supply of the developing material 14 from the rear end toward the developing roller 13.

Figure 11:
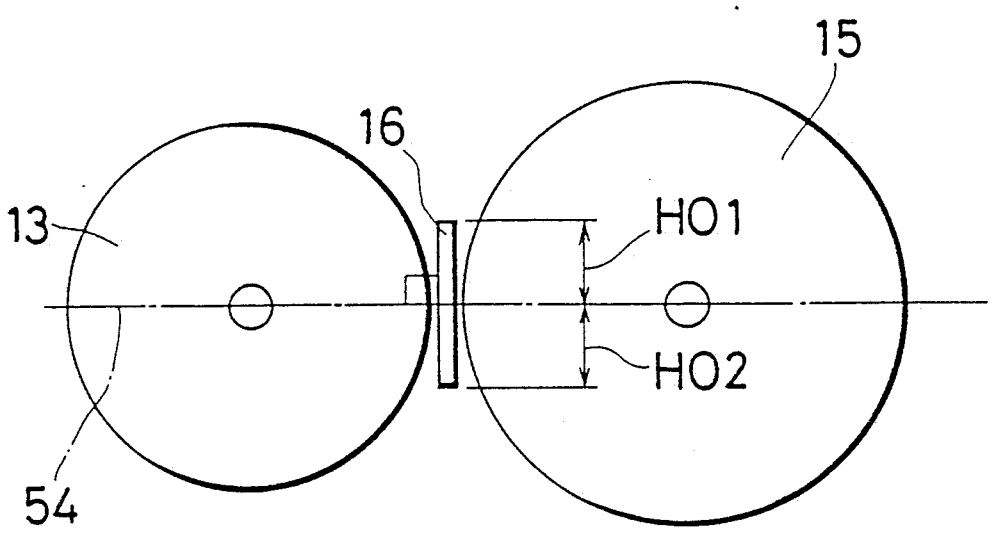
FIG. 11 is a schematic side view showing the developing roller 13, stirring member 15, and the stirring aiding plate 16.

The overall height H0 of the stirring aiding plate 16 is set so that, as FIG. 11 shows, its upper portion is positioned above a center line 54 connecting between the center of the developing roller 13 and the center of the stirring roller 15, the upper portion having a height of H01 =3 to 5 mm, the lower portion having a height of H02=5 mm (H0=H01+H02). For example, if H01 is too large, image pattern irregularity is liable to occur due to unsatisfactory transport of the developing material 14, while if H01 is too small, V-shaped image irregularity, or V-pattern, attributable to the stirring member 15 is liable to occur. Setting at H01=3 mm as in this embodiment can eliminate the problem of poor transport. It is noted that at H01=5 mm, good effect is expected against the problem of V-pattern, but no significant effect is expected against the problem of unsatisfactory transport.

The notch 34 of the stirring aiding plate 16 has an inclined portion 34*a*, and the notch 35 has a slope. Through these notches 34, 35, any abrupt change in the amount of toner in the axial direction of the developing roller 13 can be prevented. The stirring aiding plate 16 has legs 55 which abut against the bottom 12*a* of the developing tank 12 to support the stirring aiding plate 16. The sensor 24 is disposed at a position spaced apart from the leg 55 (see FIG. 8).

Referring to FIG. 11, the stirring aiding plate 16 is perpendicular to center line 54 passing through the centers of the developing roller 13 and stirring member 15. This can prevent the stirring aiding plate 16 from contacting the developing roller 13 or stirring member 15 in the narrow space between them. Furthermore, by this arrangement it is possible to allow the developing material 14 to flow in separate flows of reasonable quantities along both sides of the stirring aiding plate 16, as in FIG. 11, as it is moved upward by the developing roller 13 and stirring member 15 through the lower space B.

Referring again to FIG. 2, the developing tank 12 has downwardly projecting supporting members 57, 58. The sensor 24 is disposed above these supporting members 57, 58 and immediately below the developing roller 13.

Figure 12:
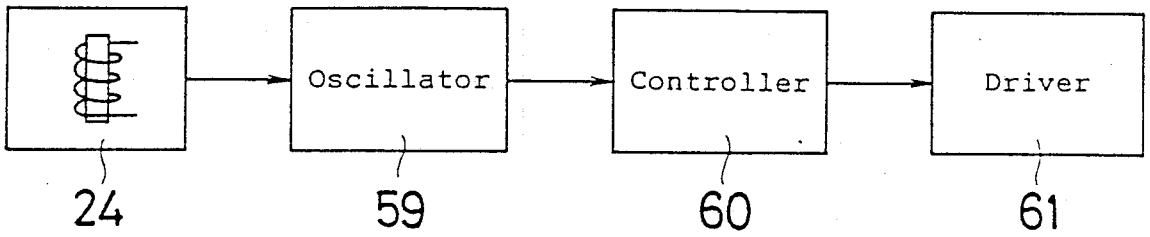
FIG. 12 is a block diagram showing an electrical arrangement associated with a sensor 24.

FIG. 12 is a block diagram showing an electrical arrangement associated with the sensor 24. The sensor 24 is in the form of a coil having an inductance depending upon the magnetic intensity of the magnetic carrier. This coil constitutes a part of a resonance circuit of an oscillator 59.

Figure 13:
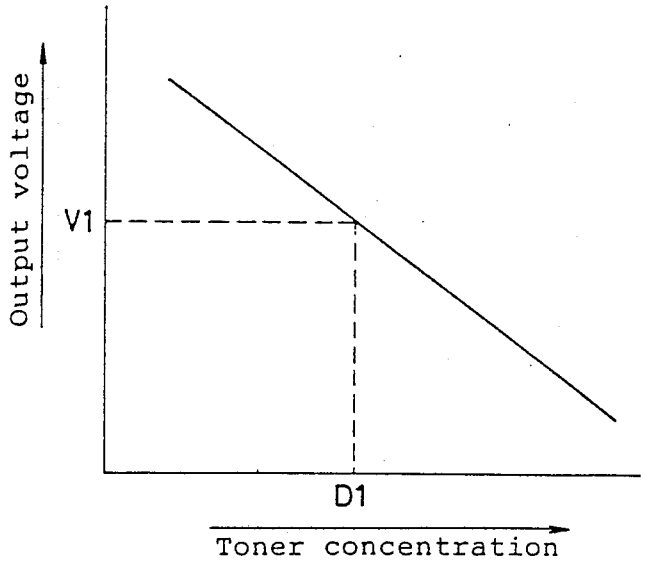
FIG. 13 is a graph for explaining the operation of the sensor 24.

FIG. 13 shows output characteristics of the oscillator 59. The magnetic intensity to be detected by the sensor 24 tends to become lower in proportion as the toner concentration of the developing material 14 becomes higher, or in other words, as the concentration of the carrier becomes lower, and accordingly the output voltage of the oscillator 59 is lowered. A controller 60, in response to the output of the oscillator 59, actuates a driver 61 for driving the supply roller 23 so as to permit its output voltage to reach a predetermined value V1. Thus, the toner is supplied through the supply roller 23 to the developing tank 12, and the toner concentration reaches a predetermined value D1.

According to the above described arrangement, as FIG. 2 shows, in the developing tank 2 the developing roller 13 rotates counterclockwise in the direction of arrow 41 and the stirring member 15 rotates clockwise in the direction of arrow 46. Then, the developing material 14 from the developing roller 13 and the developing material 14 from the stirring member 15 strike against each other in the lower space B, and further a turbulence effect is caused by the stirring aiding plate 16, whereby stirring is carried out.

By the stirring aiding plate 16 being interposed between the developing roller 13 and the stirring roller 15, the developing material 14 is prevented from being scraped by the stirring member 15 from the developing roller 13.

Furthermore, the developing material 14 scraped by the doctor blade 25 is allowed to return to the stirring member 15 passing through the upper space A and is thus stirred by the stirring member 15 again.

Now, if the stirring aiding plate 16 is disposed in such a way that it extends upward so high as to contact with the top face 12*b* of the cover 40 for the developing tank 12, trouble arises because a stagnant mass of the developing material 14 may be formed between the doctor blade 25 and the stirring aiding plate 16. Another problem is that the developing material 14 from the stirring member 15 can only be supplied to the developing roller 13 from below, which will naturally result in reduced toner concentration in the developing material 14 on the developing roller 13.

If the stirring aiding plate 16 is kept in contact with the bottom 12*a* of the developing tank 12, a stagnant mass of developing material 14 is formed under the developing roller 13, which will render the operation of the toner concentration sensor 24 unstable or unsatisfactory.

In this embodiment, as above described, the developing roller 13 and the stirring member 15 are isolated from each other, and therefore there is no possibility of the developing material 14 on the developing roller 13 being scraped through the rotation of the stirring member 15 in the course of transport. Further, while it is noted that a stagnant mass of the developing material 14 is constantly making a periodic movement in the axial direction of the developing roller 13, by providing spaces A, B above and below the stirring aiding plate 16, it is possible to eliminate the possibility of the flow of the developing material 14 being disturbed and also to solve the problem of transport irregularity of the developing material 14 to the developing roller 13. Thus, it is possible to obtain improved image quality. In the above case, the sensor 24 is enabled to perform accurate detection of toner concentration.

It is understood that this invention is not limited to the above described embodiment, but the embodiment may be altered, modified, and varied within the scope of the invention.

For example, the dimensions, etc. of the stirring aiding plate 16 are not limited to those described with respect to the embodiment, but they may be of such dimensions that can prevent possible stirring and transport irregularities of the developing material 14.

Therefore, such variations are not to be regarded as a departure from the spirit and scope of the invention, and all such modifications as would be obvious to one skilled in the art are intendedr to be included within the scope of the following claims.

What is claimed is:

1. A developing apparatus comprising:

a developing tank for storing a developing material, said developing tank having a top and a bottom, said developing material generally forming a pool at the bottom of the developing tank;

a developing roller disposed in the developing tank for forming a magnetic brush thereof;

a stirring member for stirring the developing material in the developing tank and for transporting the developing material toward the developing roller; and a stirring aiding plate disposed between and immediately adjacent to the developing roller and the stirring member and being generally disposed in the pool of developing material, the stirring aiding plate and the bottom of the developing tank defining a space therebetween, and the stirring aiding plate and the top of the developing tank defining a space therebetween, said spaces allowing passage of the developing material.

2. The developing apparatus as claimed in claim 1, wherein the developing roller and the stirring member are driven to rotate so as to move the developing material toward the stirring aiding plate upwardly from below.

3. The developing apparatus as claimed in claim 1, wherein a sensor is disposed at a position below the developing roller and adjacent to stirring aiding plate for detecting magnetic intensity corresponding to a mixture ratio of a toner and a magnetic carrier.

4. The developing apparatus as claimed in claim 1, wherein the stirring aiding plate has a generally flat plate-shape disposed generally perpendicular to a plane including both rotation axes of the developing roller and the stirring member.

5. The developing apparatus as claimed in claim 1, wherein the stirring member comprises:

a rotary shaft;

first stirring blades having a generally flat plate-shaped, said first stirring blades being fixed to the rotary shaft and extending with a degree of inclination relative to the axis of the rotary shaft, each of said first stirring blades having a notch to allow the developing material to pass therethrough in an axial direction; and second stirring blades fixed to the rotary shaft and being disposed between the first stirring blades, each of the second stirring blades extending generally along a diametric line of the rotary shaft.

6. The developing apparatus as claimed in claim 5, wherein the stirring aiding plate is configured lower at ends thereof in the axial direction of the stirring member than at the height of a median portion thereof.

7. The developing apparatus as claimed in claim 1, wherein said developing roller is positioned to one side of the stirring member and the stirring aiding plate is disposed between the developing roller and stirring member which are positioned side-by-side.

8. A developing apparatus comprising:

a developing tank for storing a developing material, said developing tank having a top and a bottom;

a developing roller disposed in the developing tank for forming a magnetic brush thereon;

a stirring member for stirring the developing material in the developing tank and for transporting the developing material toward the developing roller;

a stirring aiding plate disposed between and immediately adjacent to the developing roller and the stirring member, the stirring aiding plate and the bottom of the developing tank defining a space therebetween, and the stirring aiding plate and the top of the developing tank defining a space therebetween, said spaces allowing passage of developing material, the developing roller and stirring member being rotated to move the developing material toward the stirring aiding plate upwardly from below; and means for detecting magnetic intensity corresponding to a mixture of toner in the developing material, said means for detecting being positioned below the developing roller and adjacent the stirring aiding plate.

9. The developing apparatus as claimed in claim 8, further comprising controlling means responsive to the means for detecting for supplying developing material to the developing tank when concentration of toner falls below a predetermined value.

10. The developing apparatus as claimed in claim 9, wherein the means for detecting comprises an oscillator with a resonance circuit having a coil, said coil having an inductance depending upon magnetic intensity of a magnetic carrier, and wherein said controlling means comprises a controller responsive to the oscillator for actuating a driver, activation of said driver causing a supply roller to deliver developing material to the developing tank.

11. A developing apparatus comprising:

a developing tank for storing a developing material;

a developing roller disposed in the developing tank for forming a magnetic brush thereon;

a stirring member for stirring the developing material in the developing tank and for transporting the developing material toward the developing roller, said stirring member comprising a rotary shaft having an axis, first stirring blades and second stirring blades, said first stirring blades having a generally flat plate shape and being fixed to the rotary shaft, said first stirring blades extending with a degree of inclination relative to the axis of the rotary shaft, each of said first stirring blades having notch means for allowing the developing material to pass therethrough in an axial direction to thereby stir the developing material along the length of the stirring member, said second stirring blades being fixed to the rotary shaft and being disposed between the first stirring blades, each of said second stirring blades extending generally along a diametric line of the rotary shaft; and a stirring aiding plate disposed between and immediately adjacent to the developing roller and the stirring member.

12. The developing apparatus as claimed in claim 11, wherein the stirring aiding plate is configured lower at ends in the axial direction of the stirring member than at the height of a median portion thereof.

13. The developing apparatus as claimed in claim 11, wherein said first stirring blades and said second stirring blades are each provided as a pair, each first one of the pair of first stirring blades being positioned on a side of a pair of second stirring blades and the first one of the pair of first stirring blades is opposite to the side of a second one of the pair of first stirring blades, each first and second one of the pair of first stirring blades being provided with notch means and said rotary shaft being positioned between each of the first and second ones of the pairs of first stirring blades.

14. The developing apparatus as claimed in claim 13, wherein each first one of the pair of second stirring blades extends in a direction from the rotary shaft which is generally parallel to a direction each second one of the pair of second stirring blades extends from the rotary shaft.

15. The developing apparatus as claimed in claim 14, wherein each of the first and second pair of second stirring blades are positioned generally in the same plane.

16. The developing apparatus as claimed in claim 11, wherein each of the second stirring blades are provided as a pair, each one of the pair of second stirring blades being positioned on opposite sides of the rotary shaft.

17. The developing apparatus as claimed in claim 16, wherein the pairs of second stirring blades are positioned generally in the same plane.

18. The developing apparatus as claimed in claim 11, wherein the notch means comprises a notch defined in a portion of each of the first stirring blades, each first stirring blade generally having the same configuration with the notch being located in generally the same position for each first stirring blade.

19. A developing apparatus comprising:

a developing tank for storing a developing material;

a developing roller disposed in the developing tank for forming a magnetic brush thereon;

a stirring member for stirring the developing material in the developing tank and for transporting the developing material toward the developing roller; and a generally flat stirring aiding plate disposed between the developing roller and the stirring member, said stirring aiding plate having two ends each having a height which is less than a height of the stirring aiding plate at a median portion thereof whereby variation in the height of the stirring aiding plate permits smooth flow of the developing material from the stirring roller to the developing roller.

20. The developing apparatus as claimed in claim 19, wherein one of the two ends of the storing aiding plate is a front end while the other is a rear end, said front end has a height less than a height of the median portion due to inclined front notch formed along the front end and the rear end has a height less than a height of the median portion due to a rear notch formed therein, said rear notch having a generally horizontal portion and an inclined portion.

21. The developing apparatus as claimed in claim 20, wherein the stirring aiding plate defines a space between a top of the developing tank and the plate and also defines a space between a bottom of the developing tank and the plate, said developing apparatus further comprising regulating means for restricting flow of developing material beneath the stirring aiding plate at the rear end thereof whereby irregular stirring and transport of the developing material is prevented, said regulating means being located on said stirring aiding plate.

22. The developing apparatus as claimed in claim 21, wherein the regulating means comprises a regulating piece extending from a lower side of the stirring aiding plate toward the bottom of the developing tank, said regulating piece being located at the rear end of said stirring aiding plate.

23. The developing apparatus as claimed in claim 19, wherein the stirring aiding plate defines a space between a top of the developing tank and the plate and also defines a space between a bottom of the developing tank and the plate, said developing apparatus further comprising regulating means for restricting flow of developing material beneath the stirring aiding plate at a rear end thereof whereby irregular stirring and transport of the developing material is prevented, said regulating means being located on said stirring aiding plate.

24. The developing apparatus as claimed in claim 23, wherein the regulating means comprises a regulating piece extending from a lower side of the stirring aiding plate toward the bottom of the developing tank, said regulating piece being located at the rear end of said stirring aiding plate.

25. The developing apparatus as claimed in claim 19, wherein the stirring aiding plate has a top edge having a contour from the front end to the rear end thereof having an upwardly inclined portion, a generally horizontal portion, a downwardly inclined portion and another generally horizontal portion.

26. The developing apparatus as claimed in claim 19, wherein the stirring aiding plate is generally inclined toward the stirring member, said stirring aiding plate defining a space between a top of the developing tank and the plate and also defining a space between a bottom of the developing tank and the plate.

27. The developing apparatus as claimed in claim 26, wherein the stirring aiding plate has a top edge having a contour from the front end to the rear end thereof having an upwardly inclined portion defining a first section of the plate, a generally horizontal portion defining a second section of the plate, a downwardly inclined portion defining a third portion of the plate and another generally horizontally portion defining a third portion of the plate.

28. The developing apparatus as claimed in claims 27, wherein the height of the second section is greater than the height of the fourth section and wherein an axis extending between the center of the developing roller and the stirring member defines an upper height portion of the stirring aiding plate and a lower height portion of the stirring aiding plate for the second section thereof, said upper height portion of the plate being greater than the lower height portion of the plate.

29. The developing apparatus as recited in claim 19, wherein an axis extends between the center of the developing roller and the stirring member, said axis bisecting said stirring aiding plate, said stirring aiding plate having a height above the axis at the median portion thereof which is greater than a height of said stirring aiding plate below the axis at the median portion thereof.

30. A developing apparatus comprising:

a developing tank for storing a developing material, said developing tank having a top and bottom;

a developing roller disposed in the developing tank for forming a magnetic brush thereon, a stirring member for stirring the developing material in the developing tank and for transporting the developing material toward the developing roller; and means for separating the developing roller and stirring member and for ensuring even flow of developing material and uniform developing material concentration along an axial direction of the developing roller.

31. The developing apparatus as claimed in claim 30, wherein the developing roller and stirring member are disposed side-by-side in a generally horizontal fashion with said means for separating and ensuring being located therebetween.

32. The developing apparatus as claimed in claim 30, wherein said means for separating and ensuring defines a space with the top of the developing tank and defines another space with the bottom of the developing tank, said developing apparatus further comprising:

regulating means for restricting flow of developing material beneath the stirring aiding plate at a rear side of said stirring aiding plate, said regulating means being located on said stirring aiding plate; and means for detecting magnetic intensity corresponding to a mixture of toner in the developing material, said means for detecting being positioned below the developing roller and adjacent the means for separating and ensuring;

said means for separating and ensuring comprising a stirring aiding plate being generally disposed in a pool of developing material which generally forms at the bottom of the developing tank, said plate being generally flat and having a height in a mid-portion which is less than the height of the ends thereof to thereby permit smooth flow of the developing material from the stirring roller to the developing roller;

said stirring member comprising a rotary shaft having an axis, first stirring blades and second stirring blades, said first stirring blades having a generally flat plate-shape and being fixed to the rotary shaft, said first stirring blades extending with a degree of inclination relative to the axis of the rotary shaft, each of said first stirring blades having notch means for allowing the developing material to pass therethrough in an axial direction tot hereby stir the developing material along the length of the stirring member, said second stirring blades being fixed to the rotary shaft and being disposed between the first stirring blades, each of said second stirring blades extending generally along a diametric line of the rotary shaft.

* * * * *